US006729170B1

(12) United States Patent
Sakaguchi et al.

(10) Patent No.: US 6,729,170 B1
(45) Date of Patent: May 4, 2004

(54) METHOD FOR FABRICATING FUSER ROLLER

(75) Inventors: Teppei Sakaguchi, Osaka (JP); Yoshiki Sakaguchi, Osaka (JP)

(73) Assignees: Samtech Corporation, Osaka (JP); Samtech International, Inc., Carson, CA (US)

( * ) Notice: Subject to any disclaimer, the term of this patent is extended or adjusted under 35 U.S.C. 154(b) by 0 days.

(21) Appl. No.: 10/308,222

(22) Filed: Dec. 3, 2002

(51) Int. Cl.[7] ..... B21B 27/06

(52) U.S. Cl. ..... 72/69; 72/84; 72/370.1; 72/370.15; 29/895.33

(58) Field of Search ..... 72/69, 80, 82, 72/84, 364, 370.1, 370.15, 370.25; 29/875, 895.3, 895.33

(56) References Cited

U.S. PATENT DOCUMENTS

| | | | | | |
|---|---|---|---|---|---|
| 2,406,059 | A | * | 8/1946 | Burch | 72/69 |
| 4,059,977 | A | * | 11/1977 | Kaporovich et al. | 72/69 |
| 4,502,310 | A | * | 3/1985 | Gnutov et al. | 72/69 |
| 6,212,926 | B1 | * | 4/2001 | Jenness | 72/69 |

FOREIGN PATENT DOCUMENTS

| | | | | |
|---|---|---|---|---|
| EP | 81700 | * | 6/1983 | 72/69 |
| JP | 63-303635 | * | 12/1988 | 72/69 |
| SU | 1227289 | * | 4/1986 | 72/69 |

OTHER PUBLICATIONS

Japanese Published Unexamined Patent Application No. 2002–123103 and an English abstract thereof.

* cited by examiner

*Primary Examiner*—Ed Tolan
(74) *Attorney, Agent, or Firm*—Nixon Peabody LLP; Donald R. Studebaker

(57) ABSTRACT

A fuser roller is obtained by heating a blank over predetermined regions starting from both the opening ends, and then necking the heated regions of the blank by moving a forming roller with rotation on the heated regions through the external pressing of the forming roller against the heated regions of the blank being rotated on its axis to draw form sidewalls integrally at both ends of a cylindrical body of the blank, respectively, and draw form cylindrical shafts integrally with the sidewalls, respectively. In this manner, the fuser roller can be fabricated using a single processing machine with respect to a single pipe member, which reduces equipment cost, further enhances production efficiency and implements low-cost production of fuser rollers.

3 Claims, 4 Drawing Sheets

METHOD FOR FABRICATING FUSER ROLLER

BACKGROUND OF THE INVENTION (1) Field of the Invention

This invention relates to methods for fabricating a fuser roller used for electrographic image formation devices.

(2) Description of Related Art

Electrographic image formation devices, such as copiers, laser printers or facsimile machines, are equipped with various kinds of rollers including a feed roller, a transfer roller, a fuser roller, a pressure roller and a delivery roller. Of these rollers, the fuser roller is a roller for introducing a paper or the like onto which a toner image has been transferred between itself and the pressure roller to fuse the toner image to the paper or the like. Such a fuser roller is generally constructed so that cylindrical shafts are extended from both ends of a cylindrical body and has a built-in heat source such as a halogen lamp.

An exemplary method for fabricating such a fuser roller will be now described with reference to FIGS. 6 to 8.

As shown in FIG. 6, first prepared are a cylindrical body 12 having a through hole 11 and a shaft member 15. The cylindrical body 12 is obtained by cutting to length an elongated pipe member 14 which is a draw member having a through hole 13 and made of metal such as an aluminum alloy, and has openings at both ends. The shaft member 15 is a forged part of stainless steel, for example, and is composed of a disk portion 16 abutted on each opening end of the through hole 11 of the cylindrical body 12, a shaft portion 17 of circular contour extending integrally from one side face of the disk portion 16, and an annular fitting portion 18 extending integrally from the other side face of the disk portion 16. A through hole 19 is formed through the disk portion 16 and the shaft portion 17.

Next, as shown in FIG. 7, the cylindrical body 12 is set to a rotating jig (not shown), the shaft member 15 is set to a pressing jig (not shown), and the annular fitting portion 18 of the shaft member 15 is fitted into one opening end of the through hole 11 of the cylindrical body 12. In this state, the axes X1 of the cylindrical body 12 and the shaft member 15 are matched with each other, and the shaft member 15 is pressed against the cylindrical body 12 while the cylindrical body 12 is rotated on the axis X1. The shaft member 15 is thus joined integrally with the cylindrical body 12 by friction welding. Also at the other opening end of the through hole 11 of the cylindrical body 12, another shaft member 15 is likewise joined integrally with the cylindrical body 12 by friction welding. As a result, as shown in FIG. 8, a pair of shaft members 15 are joined concentrically and integrally with the cylindrical body 12 at both ends of the through hole 11, thereby obtaining a fuser roller 20 in which the through holes 11 and 19 are communicated with each other. The through hole 11 of the cylindrical body 12 forms an accommodation space which accommodates a heat source such as a halogen lamp. Since this prior art, however, does not relate to any publicly described invention, there is no information concerning prior art documents to be cited (this prior art is hereinafter referred to as Prior Art 1).

As an alternative fabrication method, there is a method comprising: first setting a cylindrical metal body to a rotating jig; machining both end portions thereof with rotation to form thin-walled portions; and plastically forming the thin-walled portions with a punch in plural steps to form shafts at both ends of the body (see, for example, Patent Document 1).

[Patent Document 1]

Japanese Unexamined Patent Publication No. 2002-123103 (page 4, FIGS. 3 and 4)

Since the above fabrication method of Prior Art 1 uses two kinds of members, i.e., the cylindrical body 12 and the shaft member 15, it is necessary to fabricate these members separately and to join the two kinds of members separately fabricated with each other. To satisfy this necessity, three kinds of processing machines are required, resulting in elevated equipment expenses. In addition, three processing steps are required, presenting problems of much production time and poor production efficiency.

On the other hand, according to the fabrication method of Patent Document 1, shafts are formed by machining both end portions of the cylindrical body. Therefore, there is no need for the step of joining two kinds of members with each other as done in Prior Art 1. As a result, the number of processing machines is correspondingly decreased thereby reducing equipment expenses. In addition, the number of processing steps is correspondingly decreased thereby enhancing production efficiency. This method, however, still employs different processing techniques of machining process and plastic formation with a punch. Therefore, even though this method can reduce equipment cost, it still necessitates two kinds of processing machines and its equipment cost is quite high. Furthermore, this method requires two processing steps and leaves room for improvement in production efficiency.

In addition, according to the fabrication method of Patent Document 1, both end portions of the cylindrical body are first machined, and the thin-walled parts created by machining are then plastically formed with a punch. Therefore, though the shafts are somewhat increased in thickness by plastic formation, they cannot obtain a sufficient thickness due to initial reduction by machining as compared with the case of undergoing no machining process, resulting in reduced rigidity. If allowance is previously provided for machining instead in order to obtain a sufficient thickness of the shafts, a thick cylindrical body must be prepared, which invites elevated unit cost of the fuser roller.

SUMMARY OF THE INVENTION

The present invention has been made in view of the foregoing points, and therefore an object of the present invention is to reduce equipment cost, further enhance production efficiency and fabricate a fuser roller at low cost by allowing a fuser roller to be fabricated with a processing machine of one kind for one pipe member.

The present invention is characterized, in order to attain the above object, by utilizing a spinning process of necking a cylindrical workpiece by pressing a forming roller against the outer periphery of the workpiece while rotating the workpiece, and specifically takes the following solutions.

More specifically, the invention claimed in claim 1 is characterized by comprising: heating a cylindrical metal blank with its both ends open over predetermined regions starting from both opening ends; and then necking the heated regions of the blank by moving a forming roller with rotation on the heated regions of the blank through the external pressing of the forming roller against the heated regions of the blank being rotated on its axis to draw form sidewalls integrally at both ends of a cylindrical body of the blank having an accommodation space for accommodating a heating element, respectively, and draw form cylindrical shafts integrally with the sidewalls in concentric relation with the body, respectively, thereby obtaining a fuser roller, said cylindrical shafts each having a shaft space communicating with the accommodation space of the body.

With the above constitution, according to the invention claimed in claim 1, the fuser roller is formed simply by necking both end portions of a single workpiece of a blank with a forming roller while rotating the workpiece. Therefore, the fuser roller can be obtained with a single processing machine without the joining of two members and any combination of different processing techniques, which reduces equipment cost. Furthermore, the fuser roller can be formed in a single processing step, which further enhances production efficiency. Moreover, since the portions to be formed into shafts are not machined, there is no need for thickening the blank in order to make allowance for machining, thereby obtaining the fuser roller at lower cost.

The invention claimed in claim 2 is characterized in that in the invention of claim 1, each said shaft is draw formed in a larger thickness than the body.

With the above constitution, according to the invention claimed in claim 2, the shaft is increased in rigidity thereby enhancing its bearing strength.

The invention claimed in claim 3 is characterized in that in the invention of claim 1, each said sidewall is extended at its inner surface toward the inside of the body in a manner to be gradually increased in thickness in proceeding from the body to the shaft so that the portion of the sidewall corresponding to the periphery of the shaft is the thickest portion thereof.

With the above constitution, according to the invention claimed in claim 3, the thickest portion can increase the joining strength of the sidewall with the shaft, and the sidewall, which gradually increases its thickness in proceeding from the body to the shaft, can increase the integrity of the shaft with the body. In addition, since the sidewall extends toward the inside of the body, this prevents the sidewall from interfering with a bearing for rotatably supporting the shaft.

DESCRIPTION OF PREFERRED EMBODIMENT

Description will be made below about a method for fabricating a fuser roller according to the present invention with reference to the drawings.

Figure 1:
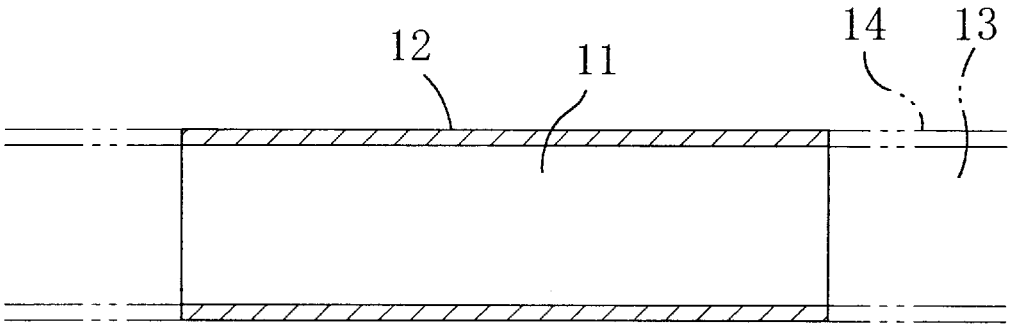
FIG. 1 is a cross-sectional view of a blank cut to length from an elongated pipe member in a fabrication method according to an embodiment of the present invention.

As shown in FIG. 1, a cylindrical metal blank 12 having a through hole 11 is first prepared. The cylindrical body 12 is obtained by cutting to length an elongated pipe member 14 which is a draw member having a through hole 13 and made of metal such as an aluminum alloy (for example, JIS A 6061 or JIS A 6063), and has openings at both ends.

Figure 2:
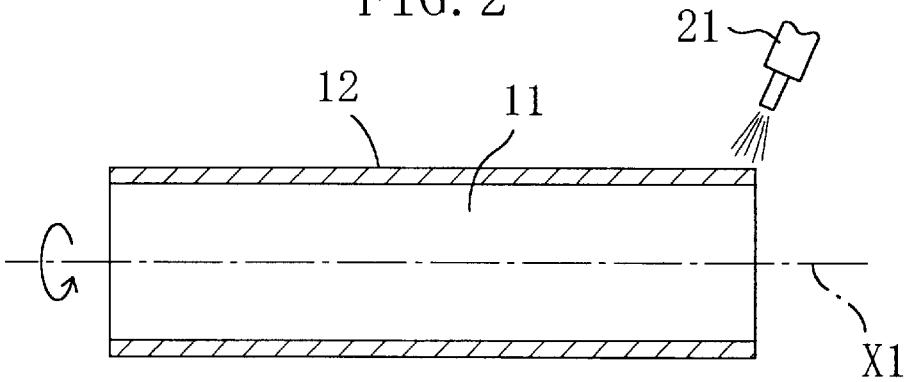
FIG. 2 is a diagram illustrating a heating step for heating the blank over a predetermined region starting from its opening end in the fabrication method according to the embodiment of the present invention.

Next, as shown in FIG. 2, the cylindrical body 12 is set to a rotating jig (not shown), and then rotated on is axis X1. In this state, one end portion of the blank 12 is heated at about 450° C. over a predetermined region starting from its opening end by a burner 21.

Figure 3:
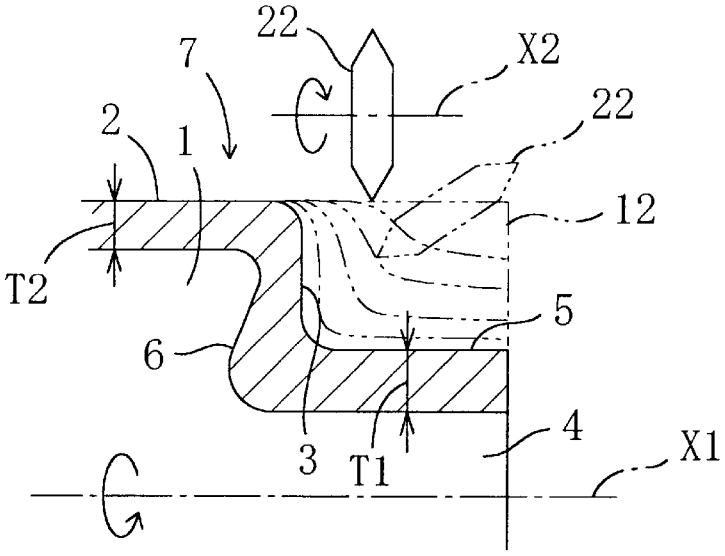
FIG. 3 is a diagram illustrating a spinning step for draw forming the blank over the predetermined region starting from its opening end in the fabrication method according to the embodiment of the present invention.

Thereafter, the heated region of the blank 12 is necked by spinning. The manner of the necking in process is as shown in FIG. 3: the blank 12 is rotated on its axis X1; and in this state a forming roller 22 is externally pressed against the heated region to rotate on its axis X2 while moving obliquely with respect to the axis X1 of the blank 12. In this manner, a sidewall 3 is integrally draw formed at one end of the blank 12, and a cylindrical shaft 5 is draw formed integrally with the sidewall 3 in concentric relation with a body 2 of the blank 12. Likewise, another sidewall 3 is integrally draw formed at the other end of the blank 12, and another cylindrical shaft 5 is draw formed integrally with said another sidewall 3 in concentric relation with the body 2.

Through this draw forming, each shaft 5 is formed in a larger thickness than the body 2, i.e., the thickness T1 of the shaft 5 is greater than the thickness T2 of the body 2, and each sidewall 3 is gradually increased in thickness in proceeding from the body 2 to the shaft 5 to extend at its inner surface toward the inside of the body 2 so that the portion of the sidewall 3 corresponding to the periphery of the shaft 5 is the thickest portion 6 thereof.

Figure 4:
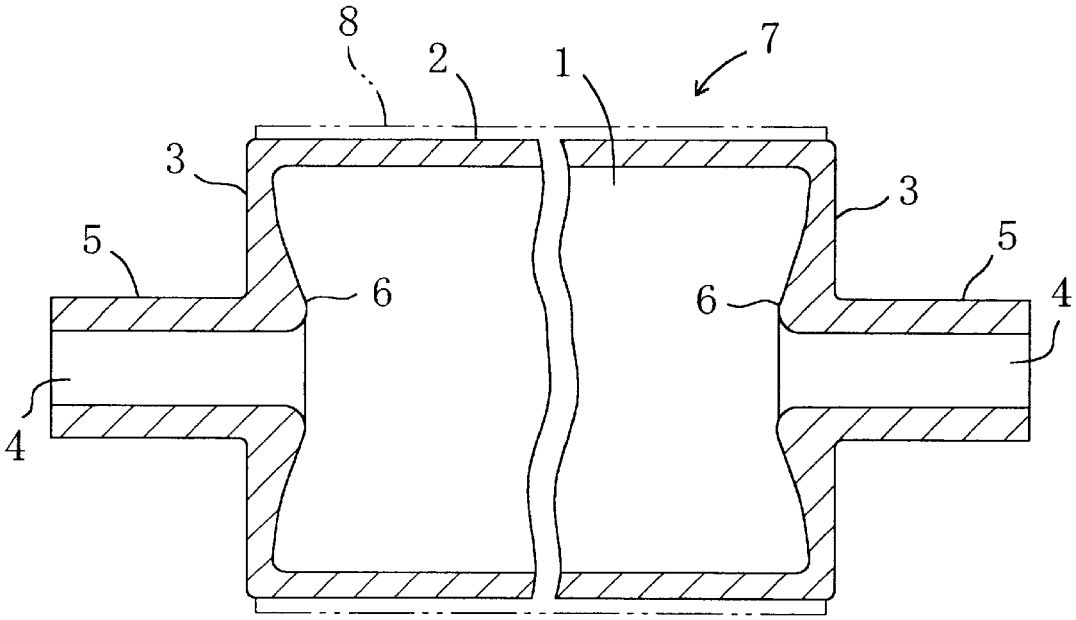
FIG. 4 is a cross-sectional view showing a fuser roller formed in the fabrication method according to the embodiment of the present invention.
Figure 5:
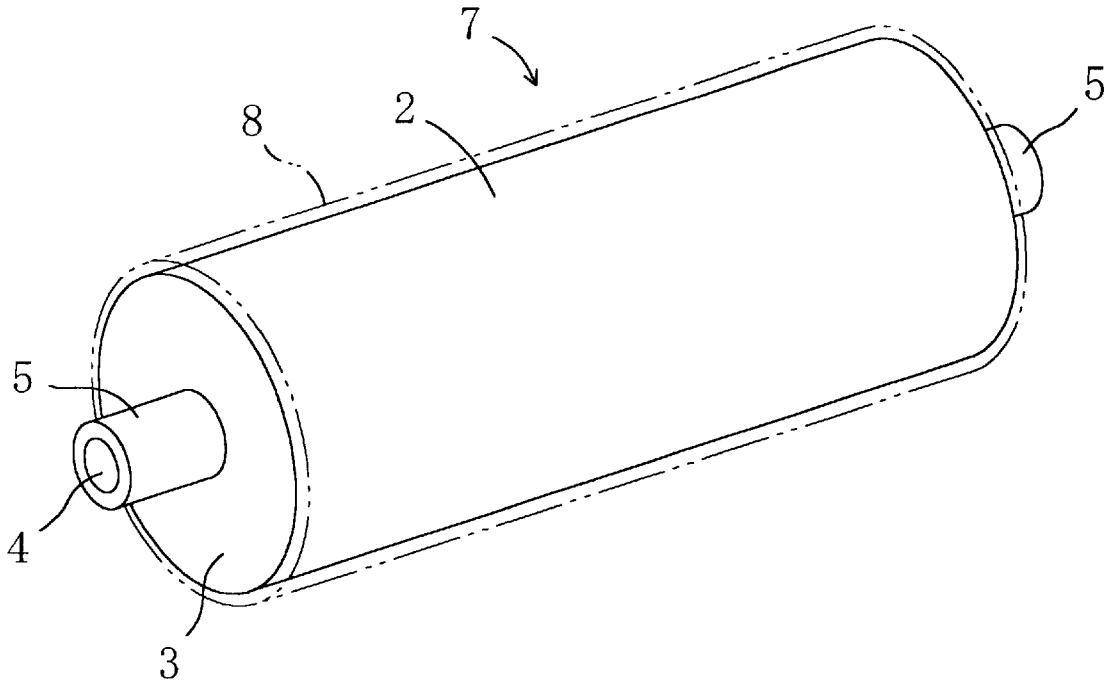
FIG. 5 is a perspective view showing the fuser roller formed in the fabrication method according to the embodiment of the present invention.
Figure 6:
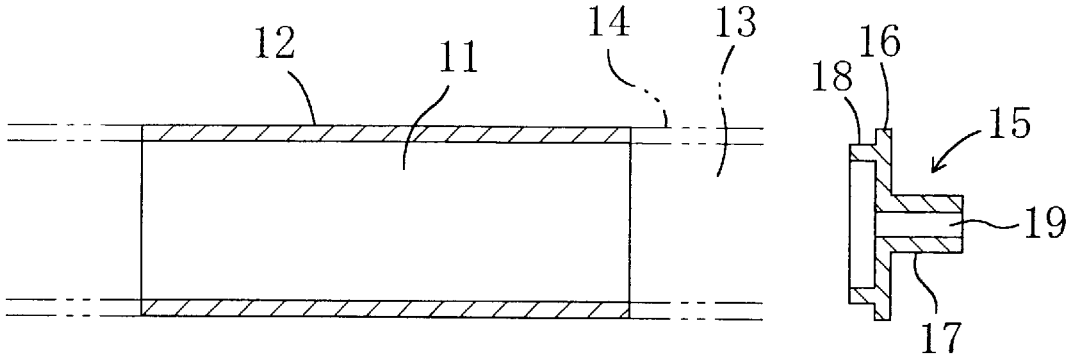
FIG. 6 is a cross-sectional view showing a roller body cut out to length from an elongated pipe member and a separately formed shaft member in a prior art method for fabricating a fuser roller.
Figure 7:
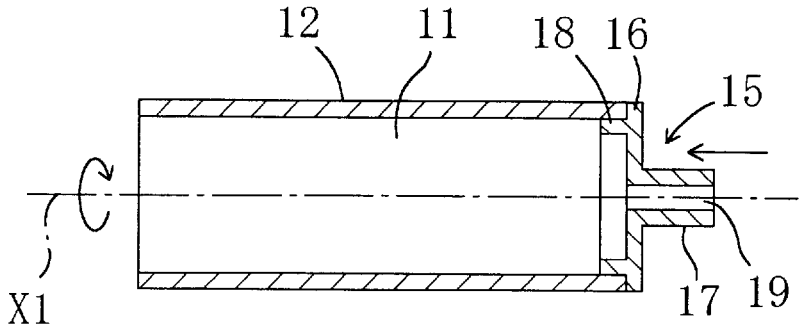
FIG. 7 is a diagram illustrating the step of joining the roller body with the shaft member in the prior art method for fabricating a fuser roller.
Figure 8:
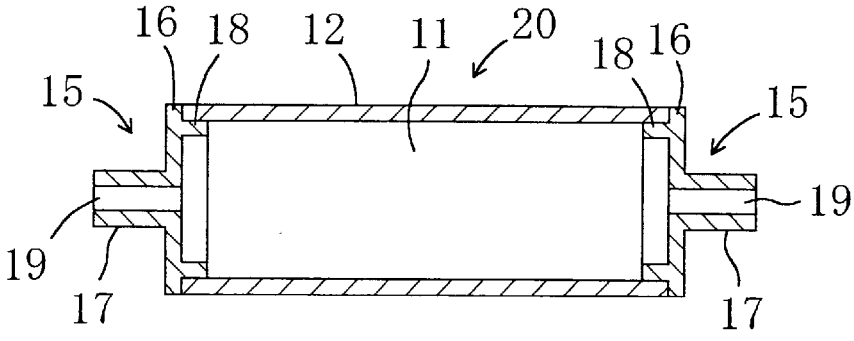
FIG. 8 is a cross-sectional view of a completed fuser roller in the prior art method for fabricating a fuser roller.

As a result, as shown in FIGS. 4 and 5, a fuser roller 7 is obtained in which sidewalls 3 are integrally draw formed at both ends of a cylindrical body 2 having an accommodation space 1 for accommodating a heating element (not shown) such as a halogen lamp, respectively, and cylindrical shafts 5 each having a shaft space 4 communicating with the accommodation space 1 of the body 2 are draw formed integrally with sidewalls 3 in concentric relation with the body 2, respectively.

The fuser roller 7 thus obtained is subjected to aging such as T6 heat treatment, and then finish machined over the entire surface. Thus, the body 2 and the shafts 5 are provided with high circularity and enhanced accuracy of their concentricity, and the corners are finished into sharp edges. Thereafter, the fuser roller 7 is formed with a coating layer 8 made of silicon rubber or teflon (R) over the outer peripheral surface of the body 2 to become available for service.

As has been described up to this point, the fuser roller 7 is formed by heating a single workpiece of a cylindrical blank 12 over predetermined regions starting from both ends, rotating the heated workpiece, and in this state necking both end portions thereof by the forming roller 22. Therefore, the fuser roller 7 can be obtained at less equipment cost with a single processing machine without the joining of two members and any combination of different processing techniques, and can be formed efficiently in a single processing step. Furthermore, since the portions to be formed into shafts 5 are not machined, there is no need for thickening the blank 12 in order to make allowance for machining, thereby obtaining the fuser roller 7 at low cost.

In addition, since each shaft 5 is draw formed in a larger thickness than the body 2, the shaft 5 increased in rigidity can enhance its bearing strength.

Furthermore, each sidewall 3 is extended toward the inside of the body 2 in a manner to be gradually increased in thickness in proceeding from the body 2 to the shaft 5 so that the portion of the sidewall 3 corresponding to the periphery of the shaft 5 is the thickest portion 6 thereof. Therefore, the thickest portion 6 can increase the joining strength of the sidewall 3 with the shaft 5, and the sidewall 3, which gradually increases its thickness in thickness in proceeding from the body 2 to the shaft 5, can increase the integrity of the shaft 5 with the body 2. In addition, since the sidewall 3 extends toward the inside of the body 2, this prevents the sidewall from interfering with a bearing for rotatably supporting the shaft 5.

What is claimed is:

1. A method for fabricating a fuser roller, characterized by comprising:

heating a cylindrical metal blank, of a first uniform thickness and having both ends open, over predetermined regions starting from both open ends; and necking the heated regions of the blank by moving a forming roller with rotation on the heated regions of the blank through the external pressing of the forming roller against the heated regions of the blank while the blank is rotated on its axis to draw form sidewalls integrally at both ends of a cylindrical body of the blank in order to form an accommodation space within the cylindrical body for accommodating a heating element, and draw to form cylindrical shafts integrally with the sidewalls in concentric relation with the cylindrical body, thereby obtaining a fuser roller, wherein during the heating and draw forming each cylindrical shaft maintains the open end to form an open shaft space communicating with the accommodation space of the body, and wherein each cylindrical shaft is draw formed to a uniform thickness greater than the first uniform thickness of the cylindrical metal body.

2. The method for fabricating a fuser roller of claim 1, wherein the external surface of each sidewall extends in a plane orthogonal to the axis of rotation of the cylindrical body.

3. The method for fabricating a fuser roller of claim 1, wherein each sidewall is extended at its inner surface toward the inside of the body in a manner to be gradually increased in thickness in proceeding from the cylindrical body to the shaft so that the portion of the sidewall corresponding to the periphery of the shaft is the thickest portion thereof.

* * * * *